United States Patent [19]

Khronopulo et al.

[11] Patent Number: 4,933,679

[45] Date of Patent: Jun. 12, 1990

[54] ANTENNA

[76] Inventors: Yury Khronopulo; Philip Gorbusky, both of 701 Empire Blvd., Brooklyn, N.Y. 11213

[21] Appl. No.: 340,140

[22] Filed: Apr. 17, 1989

[51] Int. Cl.[5] ..... H01Q 1/38

[52] U.S. Cl. ..... 343/700 MS; 343/846

[58] Field of Search ..... 343/700 MS, 731, 829, 343/831, 846; 333/127, 128

[56] References Cited

U.S. PATENT DOCUMENTS 4,238,798 12/1980 Aitken et al. ..... 343/700 MS
4,320,401 3/1982 Schiavone ..... 343/700 MS
4,654,668 3/1987 Schwartz et al. ..... 343/700 MS

FOREIGN PATENT DOCUMENTS 2091944 8/1982 United Kingdom ..... 343/700 MS

*Primary Examiner*—Rolf Hille
*Assistant Examiner*—Doris J. Johnson
*Attorney, Agent, or Firm*—Ilya Zborovsky

[57] ABSTRACT

An antenna has an antenna unit or an array of antenna units, each having a plurality of radiating elements each in turn having a plurality of open-circuit stubs spaced from one another by a distance substantially smaller than a wavelength of a guided wave travelling through the antenna.

14 Claims, 1 Drawing Sheet

ANTENNA

BACKGROUND OF THE INVENTION

The present invention relates to a stripline antenna. More particularly, it relates to a stripline antenna of a long electric length with a modulated phase velocity of a guided wave, operating in a leaky-wave mode.

Antennas of the above mentioned general type are known in the art. The exisiting stripline antennas demonstrate constancy of bandwidth by gain (electrical length) product. The known stripline antennas are generally of two types, namely: short in terms of wavelength but wideband flat patch antennas, and electrically long but using standing wave mode of operation and therefore narrow-band antennas. The antennas of both these types usually require extensive experimentation when being developed. This is partially an explanation of the reason why it is extremely difficult to make them up into a big aperture antenna array.

SUMMARY OF THE INVENTION

Accordingly, it is an object of the present invention to provide an antenna which avoids the disadvantages of the prior art.

More particularly, it is an object of the present invention to provide a stripline antenna operating in a leaky-wave mode with a modulated phase velocity of a guided wave, which can be manufactured in a simple way using printed circuit technology and which provides electromagnetic parameters comparable to or better than those of existing dish parabolic antennas.

In keeping with these objects and with others which will become apparent hereinafter, one feature of the present invention resides, briefly stated, in an antenna which comprises at least one or a plurality of antenna units each having a plurality of radiating elements, wherein each of the radiating elements has a plurality of open-circuit stubs spaced from one another by a distance which is substantially smaller than an average wavelength of guided wave travelling through the antenna and arranged symmetrically relative to a longitudinal axis of the radiating element.

When the antenna is designed in accordance with the present invention, it avoids the above-mentioned drawbacks of the prior art and provides the above-mentioned advantages.

The novel features of the present invention are set forth in particular in the appended claims. The invention itself, however, both as to its construction and its manner of operation will be best understood from the following description of preferred embodiments, which is accompanied by the following drawings.

BRIEF DESCRIPTION OF THE DRAWINGS

FIG. 3 is a perspective view of an antenna array composed of a plurality of individual flat-stub antenna units;

DESCRIPTION OF PREFERRED EMBODIMENTS

Figure 1:
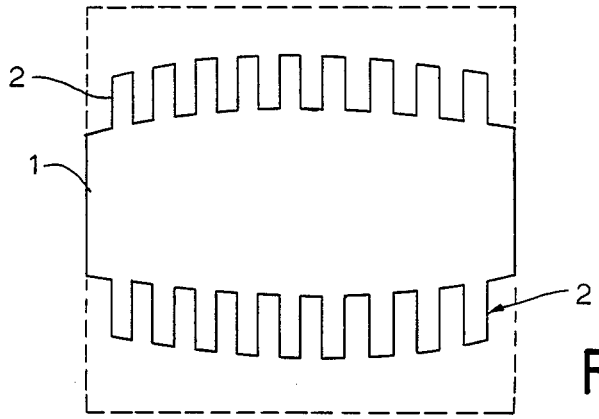
FIG. 1 is a view showing a radiating element of a flat stub-loaded stripline antenna in accordance with the present invention.
Figure 2:
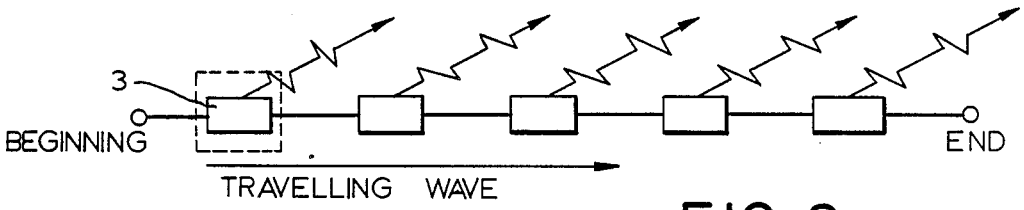
FIG. 2 is a schematic view of an antenna unit composed of a plurality of consecutively connected radiating elements.
Figure 2:
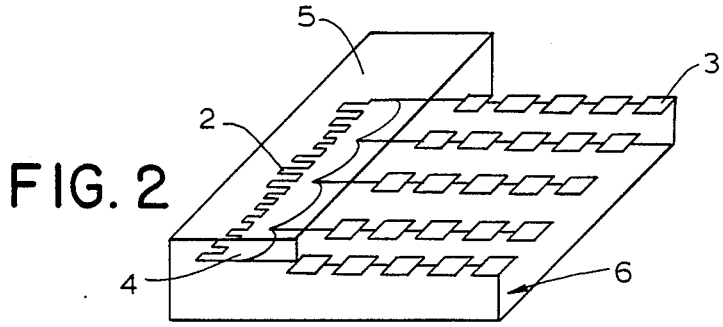

An antenna in accordance with the present invention includes at least one antenna unit or a plurality of antenna units assembled in an array. Each antenna unit is formed as a chain of radiating elements 3 connected with one another as shown in FIG. 2. Each radiating element 3 includes a stripline 1 with a variable width and two sets of stubs 2 formed symmetrically relative to each other. The length of the stubs vary along a longitudinal axis of the antenna unit as shown in FIG. 1. The antenna units are positioned above an element provided with a metallic reflective surface 6 as shown in FIG. 3.

The stripline antenna unit composed of the radiating elements 3 guides a slowed-down wave with a modulated phase velocity. As the guided wave travels along the antenna unit (FIG. 2), a part of its energy is radiated (leaky-wave mode of operation). In accordance with the present invention, the antenna is substantially wide band by providing the distance between any two neighboring loading stubs 2 substantially less than the average wavelength of a guided wave, for example 0.1 of the guided wave wavelength, or less. The length of the radiating element 3 is equal to the average wavelength of the guided wave.

Since the leaky-wave mode of operation implies that a travelling wave propagates in the structure, the stripline width at any given point along its longitudinal axis and the stub input impedance (i.e. its length) must comply with the condition of the travelling wave propagation. The above-mentioned variations of the stripline width and of the input impedance of the loading stubs can be calculated from the equations of the transmission line theory. It should be born in mind when doing so that the stripline is loaded with the dissipative radiation resistance.

The parameters of the antenna unit can be calculated in accordance with the following main equation:

$$\beta^2(x) = Y(x) \cdot Z(x)$$

wherein $\beta = \beta_0(1 + \beta_1 \mathrm{Cos}\beta_0 x)$— a phase constant of a travelling wave with a modulated phase velocity;

$\beta_0$—average phase constant $\beta_1$—phase constant deviation;

x—coordinate of the longitudinal axis of the antenna unit;

Y—shunt admittance per unit length of the guiding system;

Z—series impendance per unit length of the guiding system.

The parameters Y and Z are determined by the geometrical dimensions of the stripline 1 and of the loading stubs 2, taking into account the radiation resistance. The antenna unit with the parameters calculated according to the above equation is capable of receiving or transmitting electromagnetic waves, in particular in the direction normal to the surface of the antenna unit.

It should be noted that although practically any amplitude distribution of current can be realized in the antenna in accordance with the present invention, best results are expected when the current amplitude of the antenna unit at the antenna termination is approximately by 10 dB less than that of its feedpoint.

The considerations presented above enable any person skilled in the art to easily build his own antenna according to the present invention.

The above described antenna units can be assembled in an antenna array formed as a undirectional broadside array shown in FIG. 3. The array is provided with a feed line 4 that feeds the antenna units in the same phase, either directly or via tapered, exponential or quarter-wavelength transformers. Amplitude distribution of the feed line is determined by sidelobe suppression requirements. The same principle of the modulated phase velocity may be employed in the feed line. The above equation is true for the feed line as well if instead of radiation resistance, distributed input resistance of radiating chains shown in FIG. 2 is taken into account. This distributed input resistance can be determined by expanding the input impedance of a radiating chain into Fourier series at the cross section where it may be considered practically active.

Figure 4:
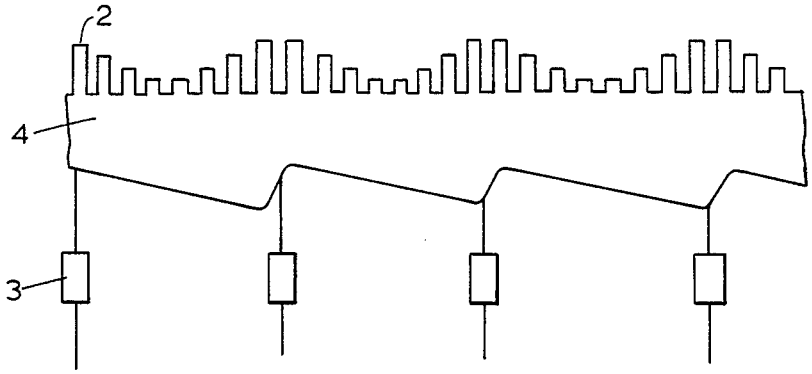
FIG. 4 is a view showing a section of a feeder line for the array of flat stub-loaded stripline antenna units, in accordance with the present invention.

For preventing radiation from the feeder line 4, it is covered by a screen 5. The feed constitutes a symmetrical stripline shown in FIG. 4. It has a plurality of stubs 2' positioned on a side of the stripline, which is opposite to the antenna units. The width of the feed line varies along its length. The distance between two neighboring stubs 2' is less than or equal to 0.1 of the average wavelength of a wave guided by the feeder line, and the period of the stripline width variation is equal to said average wavelength. The width variations and the variations of lengths of the stubs 2' must correspond to such changes of Y(x) and Z(x) as to comply with the above equation. In this case the travelling wave with modulated phase velocity will propagate in the feed line. The radiating antenna units or chains are connected to the feed line on its side facing toward them and at the points of sharp width variations to obtain an in-phase exitation. The connection can be performed directly or through tapered, exponential or quarter-wavelength transformers.

As can be seen from FIG. 3, the antenna array shown there can be integrated into different configurations by means of waveguides or other guiding systems, to obtain exceptionally big apertures. It is likewise evident that the antenna array described above will transmit/-receive linearly polarized electromagnetic waves. In some applications, circularly polarized waves are used. In this case the array in accordance with the present invention can be utilized together with a polarizer of some kind. Since the array belongs to a class of leaky-wave antennas, its far-field zone begins at several inches distance from its surface, and covering the array with a layer of polarizer structure does not affect its operation.

The present invention is not limited to the details shown since various modifications and structural changes are possible without departing in any way from the spirit of the invention.

What is desired to be protected by Letters Patent is set forth in particular in the appended claims.

We claim:

1. An antenna, comprising at least one antenna unit including a plurality of consecutively radiating elements, each of said radiating elements having a stripline extending in a direction of a guided wave through said antenna unit and two sets of open-circuited stubs arranged at opposite sides of said stripline as considered in a direction transverse to the direction of travelling of the guided wave, the stubs of one of said sets of stubs being symmetrical relative to the stubs of the other of said sets of stubs, the stubs of each of said sets of stubs being spaced from one another by a distance considerably smaller than an average wavelength of the guided wave travelling through said antenna unit.

2. An antenna as defined in claim 1, wherein each of said radiating elements has a width as measured in the direction transverse to a direction of travelling of the guided wave, said width being variable.

3. An antenna as defined in claim 2, wherein said stripline of each of said radiating elements has a variable width to provide said variable width of said radiating element.

4. An antenna as defined in claim 2, wherein said stubs of each of said radiating elements extend in said transverse direction and have a variable length which provides said variable width of each of said radiating elements.

5. An antenna as defined in claim 1; and further comprising a ground plane located underneath said antenna unit and having a reflecting surface facing toward said antenna unit.

6. An antenna as defined in claim 1, comprising a plurality of antenna units each including a plurality of radiating elements and having one end; and further comprising a feed line connected with said one end of each of said antenna units.

7. An antenna as defined in claim 6, wherein said feed line has a plurality of open-circuit stubs which are spaced from one another by a distance considerably smaller than an average wavelength of the guided wave travelling through the antenna.

8. An antenna as defined in claim 7, wherein said feed line has a first side facing toward said antenna units, said stubs being provided on said second side of said feed line.

9. An antenna as defined in claim 8, wherein said first side of said feed line is wave-like and connected to said antenna units so that said one end of each of said antenna units is connected with said first side of said feed line in a point of sharp width variation of said feed line.

10. An antenna as defined in claim 1, wherein the distance between said open-circuit stubs of each of said radiating elements of said antenna unit is substantially equal to 0.1 of the average wavelength of the guided wave.

11. An antenna as defined in claim 1, wherein each of said radiating elements has a length which is substantially equal to the average wavelength of the guided wave.

12. An antenna as defined in claim 7, wherein the distance between said open-circuit stubs of said feed line is equal at most to 0.1 of the average wavelength of the guided wave.

13. An antenna as defined in claim 6, wherein said feed line has a variable width with a pitch of a width variation substantially equal to the average wavelength of the guided wave.

14. An antenna as defined in claim 6; and further comprising means for preventing radiation from said feed line and including a screen member associated with and partially covering said feed line.

* * * * *